US006540796B2

(12) United States Patent
De Groot et al.

(10) Patent No.: US 6,540,796 B2
(45) Date of Patent: Apr. 1, 2003

(54) USE OF TRIOXEPANS IN IGNITION IMPROVED FUELS

(75) Inventors: Johannes J. De Groot, Gorssel (NL); John Meijer, Deventer (NL)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/930,401

(22) Filed: Aug. 15, 2001

(65) Prior Publication Data

US 2002/0038524 A1 Apr. 4, 2002

Related U.S. Application Data

(60) Provisional application No. 60/225,315, filed on Aug. 15, 2000.

(51) Int. Cl.[7] ..... C10L 1/18
(52) U.S. Cl. ..... 44/329; 44/436; 44/437
(58) Field of Search ..... 44/329, 436, 437, 44/447

(56) References Cited

U.S. PATENT DOCUMENTS

| | | | | |
|---|---|---|---|---|
| 2,378,341 A | 6/1945 | Vaughan et al. | ..... | 44/322 |
| 3,003,000 A | 10/1961 | Milas | ..... | 568/562 |

FOREIGN PATENT DOCUMENTS

| | | | | |
|---|---|---|---|---|
| EP | 355733 | 2/1990 | ..... | C07C/409/40 |
| WO | 98/50354 | 11/1998 | ..... | C07C/409/00 |

OTHER PUBLICATIONS

Kirk–Othmer Encyclopedia of Chemical Technology, Third Edition (1982), vol. 17, pp. 27 and 57.

Q.T. Wiles et al., "[Di–tert–butyl Peroxide and 2,2–Bis(tert–butylperoxy)butane]: Applications", Industrial and Engineering Chemistry, vol. 41, No. 8, Aug., 1949, pp. 1679–1682.

G.E. Coughenour et al., "Di–t–butyl Peroxide as a Diesel Fuel Additive", Chemtech, Aug., 1997, pp. 38–41.

L.N. Allard et al., "Analysis of the Ignition Behaviour of the ASTM D–613 Primary Reference Fuels and Full Boiling Range Diesel Fuels in the Ignition Quality Tester (IQT™)–Part III", SAE Technical Paper Series (1999–01–3591), pp. 1–8.

*Primary Examiner*—Cephia D. Toomer
(74) *Attorney, Agent, or Firm*—Richard P. Fennelly

(57) ABSTRACT

The invention relates to use of trioxepan compounds of formula I (I)

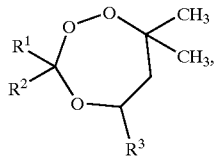

with $R^{1-3}$ being independently selected from substituted or unsubstituted hydrocarbyl groups in the process to make fuels with improved ignition properties. Preferably, $R^1$ and $R^3$ are selected from lower alkyl groups, such as methyl, ethyl, and isopropyl, while $R^2$ is preferably selected from methyl, ethyl, isopropyl, isobutyl, amyl, isoamyl, cyclohexyl, $CH_3C(O)CH_2$—, $C_2H_5OC(O)CH_2$—, HOC $(CH_3)_2CH_2$—, and

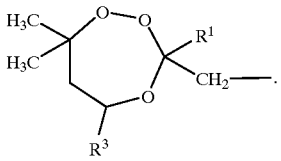

9 Claims, No Drawings

USE OF TRIOXEPANS IN IGNITION IMPROVED FUELS

This application claims the benefit of Provisional application Ser. No. 60/225,315, filed Aug. 15, 2000.

The invention relates to fuels with improved ignition characteristics comprising one or more peroxides.

The use of peroxides in fuels has long been common knowledge. Back in the 1940s U.S. Pat. No. 2,378,341 disclosed the use of a peroxide of a hydrocarbon having at least one aliphatic tertiary carbon atom, the peroxy radical in said peroxide connecting two tertiary carbon atoms, while *Ind. Eng. Chem.,* Vol. 41, No. 8, pp. 1679–1682 disclosed the use of di-tert-butyl peroxide and 2,2-bis(tert-butylperoxy)butane for the purpose of improving the ignition of diesel fuels.

In 1961, U.S. Pat. No. 3,003,000 disclosed ketone peroxides and oligomeric ketone peroxides, a process to make them, and their generic use in, inter alia, diesel fuels.

Ignition improvers are desired for use in hydrocarbon distillates and residue-containing oils that are useful as fuels for combustion engines except for their ignition characteristics. Usually, such fuels suffer from a too long ignition lag, i.e., the time between the injection of the fuel into the zone of combustion, as in directly injected engines such as diesel engines, and the moment the fuel ignites, or the time between the activation of external ignition sources, such as spark plugs, and the moment the fuel ignites. As a result, poor combustion efficiency and rough engine operation are observed, with all attendant adverse consequences. The term improved ignition, therefore, means that in combustion engines fuel is burned with improved efficiency, which relates to a higher cetane number of the fuel and a reduced emission of pollutants upon combustion of the fuel in said engine. As is well-known, the use of diesel fuel with improved ignition can result in reductions of the hydrocarbon, carbon monoxide, NOx, and particulate matter (soot) emissions. Depending on the type of fuel and the type and quantity of ignition improver used, reductions of 40% of said emissions are quite feasible.

Presently used commercial products to improve the ignition of (diesel) fuels are di-tert-butyl peroxide and 2-ethylhexyl nitrate, as taught by *Chemtech,* 8–97, pp. 38–41. However, these products suffer from various disadvantages. Nitrates may lead to NOx formation upon combustion, while di-tert-butyl peroxide has a low flash-point and high volatility, which can lead to various safety hazards. Nor do most peroxides possess long-term (thermal) stability in diesel fuels. Especially at higher temperatures such as can be encountered in fuel systems, decreased thermal stability can lead to gum formation or other degradation of the fuel. Also, the decomposition products of peroxides generally are (partly) alcoholic in nature, which tends to increase the undesired water uptake by the fuel. Furthermore, most of the peroxides used thus far suffer from a relatively low active matter content and a relatively poor efficiency in improving the cetane number of the fuel. In consequence, there still is a need for fuels with improved characteristics.

Surprisingly, we have found that a specific class of peroxides is very suitable for improving the ignition characteristics of fuels. Accordingly, we claim the use of such peroxides to make ignition improved fuels, as well as the fuel so obtained and the use of said improved fuel.

The fuel according to the invention is characterized in that it comprises from 0.001 to 10 percent by weight of one or more trioxepan compounds, or substituted 1,2,4-trioxacycloheptanes, selected from the group of peroxides represented by formula I (I)

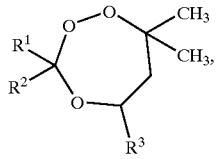

with $R^{1-3}$ being independently selected from hydrogen and substituted or unsubstituted hydrocarbyl groups. Preferably, $R^{1-3}$ are independently selected from the group consisting of hydrogen and substituted or unsubstituted $C_1$–$C_{20}$ alkyl, $C_3$–$C_{20}$ cycloalkyl, $C_6$–$C_{20}$ aryl, $C_7$–$C_{20}$ aralkyl, and $C_7$–$C_{20}$ alkaryl, which groups may include linear or branched alkyl moieties; the optional one or more substituents on each of $R^1$–$R^3$ being selected from the group consisting of hydroxy, alkoxy, linear or branched alkyl, aryloxy, halogen, ester, carboxy, nitrile, and amido. Preferably, $R^1$ and $R^3$ are selected from lower alkyl groups, such as methyl, ethyl, and isopropyl, methyl and ethyl being most preferred. $R^2$ is preferably selected from hydrogen, methyl, ethyl, isopropyl, isobutyl, tertbutyl, amyl, isoamyl, cyclohexyl, phenyl, $CH_3C(O)CH_2$—, $C_2H_5OC(O)CH_2$—, $HOC(CH_3)_2CH_2$—, and

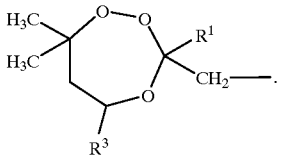

The use of the trioxepans according to the invention was found to increase the cetane number of the fuel to an unexpectedly high level, and to reduce the ignition time, proving the products to be very efficient. Therefore, they are considered to be very good candidates for replacing conventional peroxides in said process.

The amount of trioxepans used to improve the ignition time of the fuel is preferably such that the cetane number of treated fuel is at least 2 higher than the cetane number of untreated fuel, when analyzed in accordance with ASTM D613. More preferably, an increase in cetane number of more than 4 is observed in said test. Since the method in accordance with ASTM D613 is not very reproducible and not very suitable for evaluating liquefied gases, the fuels are preferably evaluated in a closed volume combuster (CVC), which relates to the Ignition Quality Tester as described, for instance, by L. N. Allard, G. D. Webster, T. W. Ryan III, A. Beregszazy, C. W. Fairbridge, G. Baker, A. Ecker and Josef Rath, in "Analysis of the Ignition Behaviour of the ASTM D-613 Primary Reference Fuels and Full Boiling Range diesel Fuels in the Ignition Quality Tester (IQM)—Part III", SAE 1999-01-3591, 1–8, 1999. In the CVC test as described below the ignition time is preferably such that it is at least 5 millisecond shorter, more preferably 10 millisecond shorter, than the ignition time of untreated fuel.

Preferably, one or more of the trioxepans according to formula I are present in the final fuel formulation in an amount of between 0.025 and 5 percent by weight (% w/w). Most preferred is a concentration of trioxepans of formula I in the fuel of between 0.05 and 2.5% w/w. Less peroxide will not result in any noticeable improvement of the ignition characteristics of the fuel, whereas a higher amount may prove to be unsafe or uneconomical.

The fuel according to the invention may contain just the peroxides of formula I as the ignition improver. However, they may also be combined with other ignition improvers, such as conventional di-tert-butyl peroxide and/or 2-ethylhexyl nitrate. If the peroxides of formula I are used together with other ignition improvers, then it is preferred that they make up at least 25% w/w, more preferably at least 50% w/w, most preferably at least 75% w/w, based on the weight of all ignition improvers in the fuel, because the ignition properties of such fuels are most efficiently improved.

The term fuels, as used throughout this document, is meant to encompass all hydrocarbon distillates and residue-containing oils for use in combustion engines and which distil between the kerosene fraction and the lubricating oil fraction of petroleum, as well as liquefied or compressed natural gas, liquid propane gas, liquid butane gas, and mixtures of the liquefied gases. The fuel may comprise the usual additives, such as anti-foam agents, injector cleaning agents, drying agents, cloud point depressants, also known as anti-gel agents, algae control agents, lubricants, dyes, and oxidation inhibitors, but may also comprise further ignition improving or combustion improving additives, provided that such additives do not adversely affect the storage stability of the final fuel composition according to the invention. Preferred fuels are diesel fuel and liquefied gases. In a most preferred embodiment, the fuel is a liquefied gas for use in a diesel engine.

When the trioxepans are used to improve liquefied gases, it can be advantageous to add one or more (aliphatic) hydrocarbon or other conventional co-additives. In a preferred embodiment a liquefied fuel, a trioxepan and one or more aliphatic hydrocarbons with a molecular weight greater than 70D, preferably greater than 100D, most preferably greater than 125D are combined to obtain an improved fuel. The molecular weight of an aliphatic hydrocarbon additive should be such that the final mixture is still a liquid. Very good results have been observed for mixtures of liquefied propane that comprise 5–50, preferably 5–40, most preferably about 20 percent by weight of the final product of a paraffin that consists of a mixture of normal alkanes with 14, 15, and 16 carbon atoms per molecule (n-C14, n-C15, and n-C16 compounds).

It is noted that certain trioxepans are known. See for instance Kirk & Othmer's *Encyclopedia of Chem. Tech.*, 3rd Ed, Vol. 17, page 57, disclosing a 1,2,4-trioxacycloheptane of formula,

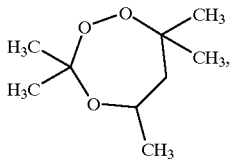

and WO 98/50354 disclosing four related trioxepan compounds, including the product of formula

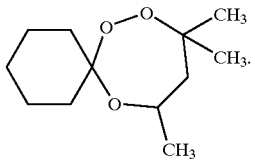

WO 98/50354 furthermore discloses the use of these compounds together with a co-agent in cross-linking processes.

The trioxepans for use according to the present invention can be synthesized in a conventional way, for example, by reacting $HOC(CH_3)HCH_2C(CH_3)_2OOH$ with a ketone, typically in the presence of a catalyst and followed by purification steps. Such a procedure is disclosed, for instance, in Example 1 of WO 98/50354.

Suitable ketones for use in the synthesis of the present peroxides include, for example, acetone, acetophenone, methyl-n-amyl ketone, ethylbutyl ketone, ethylpropyl ketone, methylisoamyl ketone, methylheptyl ketone, methylhexyl ketone, ethylamyl ketone, dimethyl ketone, diethyl ketone, dipropyl ketone, methylethyl ketone, methylisobutyl ketone, methylisopropyl ketone, methylpropyl ketone, methyl-t-butyl ketone, isobutylheptyl ketone, diisobutyl ketone, 2,4-pentanedione, 2,4-hexanedione, 2,4-heptanedione, 3,5-heptanedione, 3,5-octanedione, 5-methyl-2,4-hexanedione, 2,6-dimethyl-3,5-heptanedione, 2,4-octanedione, 5,5-dimethyl-2,4-hexanedione, 6-methyl-2,4-heptanedione, 1-phenyl-1,3-butanedione, 1-phenyl-1,3-pentanedione, 1,3-diphenyl-1,3-propanedione, 1-phenyl-2,4-pentanedione, methylbenzyl ketone, phenylmethyl ketone, phenylethyl ketone, methylchloromethyl ketone, methylbromomethyl ketone, and coupling products thereof. Of course, other ketones having the appropriate R groups corresponding to the peroxides of formula I can be employed, as well as mixtures of two or more different ketones.

Examples of preferred ketones are acetone, methylethyl ketone (any isomer), diethyl ketone (any isomer), methylpropyl ketone (any isomer), methylbutyl ketone (any isomer), methylamyl ketone (any isomer), methylhexyl ketone (any isomer), methylheptyl ketone (any isomer), ethylpropyl ketone (any isomer), ethylbutyl ketone (any isomer), ethylamyl ketone (any isomer), ethylhexyl ketone (any isomer), cyclohexanone, acetylacetone, ethylacetoacetate, diacetone alcohol, and mixtures thereof.

The peroxides can be prepared, transported, stored, and applied as such or in the form of powders, granules, pellets, pastilles, flakes, slabs, pastes, and solutions. These formulations may optionally be phlegmatized, as necessary, depending on the particular peroxide and its concentration in the formulation. Preferred phlegmatizers are selected from the group consisting of hydrocarbons, such as (diesel) fuel, paraffinic and white oils, oxygenated hydrocarbons, such as ethers, aldehydes, epoxides, esters, ketones, alcohols, and organic peroxides, such as linear ketone peroxides and di-tert-butyl peroxide, alkyl nitrates, such as 2-ethylhexyl nitrate, and mixtures thereof. Examples of preferred liquid phlegmatizers for the trioxepans include alkanols, in particular higher aliphatic alkanols, cycloalkanols, alkylene glycols, alkylene glycol monoalkyl ethers, ethers, in particular methyl tert-butyl ether, aldehydes, ketones, epoxides, esters, hydrocarbon solvents, including toluene, xylene, (diesel) fuel, paraffinic oils, and white oils. More preferred liquid phlegmatizers are ethers and hydrocarbons. Most preferably, a fuel is used as the phlegmatizer. For liquefied fuels according to the invention, it is preferred to use the aliphatic hydrocarbon co-additive as the (co)phlegmatizer. A concentrated trioxepan composition is very suitable for further dilution with fuel in order to obtain a fuel comprising an ignition improving amount of said peroxide.

The invention is elucidated by the following examples.

Experimental

The CVC equipment and the method to measure the ignition time of fuels is as follows:

In a CVC the fuel is injected in compressed and heated air. At the top of the combustion chamber connections have been made for air in and air out. The same connections are used for measurement of the pressure and the temperature in the combustion chamber. A static pressure gauge measures the air pressure in the combustion chamber before ignition. The pressure during combustion of the fuel is recorded with a high speed pressure gauge. The pressure pulse of the combustion is registered by a piezo electric dynamic pressure gauge. In the set-up as used to evaluate the present invention, fuel is injected into an electrically heated combustion chamber of 100 ml that was thermostatted at 400° C. and equipped with a "Unijet" fuel injector of a 1999 Alpha Romeo 156 diesel engine. The fuel inlet of the injector is connected to a high pressure fuel circuit. The top of the injector is cooled with water and the temperature of the water near the injector is controlled at 24/25° C.

Before each experiment the combustion chamber was flushed five times with air. Thereafter the air was pressurized to 6 bara (5 barg) and the CVC was allowed to reach temperature equilibrium in a period of 5 minutes. Then the injector of the CVC was activated by a 10 Volt electrical pulse with a controlled duration from 1 to 10 $\mu$m. The pulse duration is chosen such that a lean explosion mixture is obtained, meaning that the amount of fuel is less than stoichiometric. At a fuel pressure of 200 bara, stoichiometric reaction conditions were found at a pulse duration of 2.85 milliseconds. In the experiments a pulse of 2.35 milliseconds at a fuel pressure of 200 bara was used. Initially the pressure drops, probably due to cooling of the contents of the CVC, wherafter the explosion follows. Information about the time to ignition, maximum pressure and pressure increase rate is obtained. The ignition time is the time is takes for the pressure, after the initial pressure drop, to reach 6 bara.

Materials Used:

Trigonox®B di-tert-butyl peroxide ex Akzo Nobel

Diesel 1 A reference diesel fuel ex Octel.

SD5 Another reference diesel fuel.

EXAMPLES 1–4 AND COMPARATIVE EXAMPLES A–F

The diesel fuels were mixed with the peroxides Trigonox B or

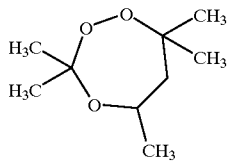

(product X) such that the final mixture contained 0.2 and 1.0% w/w of peroxide. The original fuel and the mixtures containing the peroxides were evaluated for their cetane number. The following results were obtained:

| Example | Fuel | Peroxide | Amount of peroxide | Cetane number |
|---|---|---|---|---|
| A | Diesel 1 | none | none | 60.3 |
| B | Diesel 1 | Trigonox B | 0.2 | 63.1 |
| C | Diesel 1 | Trigonox B | 1.0 | 68.9 |
| 1 | Diesel 1 | Product X | 0.2 | 63.4 |
| 2 | Diesel 1 | Product X | 1.0 | 68.3 |
| D | SD5 | none | none | 55.0 |
| E | SD5 | Trigonox B | 0.2 | 57.6 |

-continued

| Example | Fuel | Peroxide | Amount of peroxide | Cetane number |
|---|---|---|---|---|
| F | SD5 | Trigonox B | 1.0 | 63.9 |
| 3 | SD5 | Product X | 0.2 | 57.1 |
| 4 | SD5 | Product X | 1.0 | 64.5 |

EXAMPLE 5

In a separate test, product X was added to liquefied propane gas (LPG) containing 20% by weight of an aliphatic hydrocarbon (consisting of 55% by weight n-C14, 37% by weight n-C15, and 8% by weight n-C16) and used in a diesel engine. Compared to a diesel engine running on the same LPG without the added peroxide, the engine ran much better.

EXAMPLES 6 AND 7 COMPARATIVE EXAMPLES G–J

In order to further evaluate the performance of the trioxepan and to compare it with conventional systems the ignition time was tested using a Closed Volume Combuster. In the table below, the amount of peroxide used is given in percent by weight of the total fuel formulation.

| Example | Fuel | Peroxide | Amount of peroxide | Ignition time (ms) |
|---|---|---|---|---|
| 6 | LPG/HC | Product X | 1.1 | 42 |
| 7 | LPG/HC | Product X | 4.6 | 30 |
| G | LPG | None | — | 85 |
| H | LPG/HC | None | — | 58 |
| I | LPG/HC | Trigonox B | 1.0 | 42 |
| J | LPG/HC | Trigonox B | 4.9 | 30 |

* = LPG/HC means the LPG/hydrocarbon mixture of Example 5.

These results demonstrate that trioxepans are efficient in reducing the ignition time of a liquefied gas fuel.

We claim:

1. A process to increase the ignition properties of a fuel wherein the process comprises adding to said fuel an effective amount of one or more trioxepan compounds, or substituted 1,2,4-trioxacycloheptanes, selected from the group of peroxides represented by formula I (I)

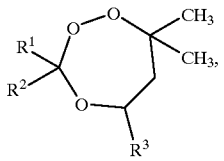

wherein $R^{1-3}$ are independently selected from hydrogen and substituted or unsubstituted hydrocarbyl groups.

2. Process according to claim 1 wherein $R^{1-3}$ are independently selected from the group consisting of hydrogen and substituted or unsubstituted $C_1$–$C_{20}$ alkyl, $C_3$–$C_{20}$ cycloalkyl, $C_6$–$C_{20}$ aryl, $C_7$–$C_{20}$ aralkyl, and $C_7$–$C_{20}$ alkaryl, which groups may include linear or branched alkyl moieties; the optional one or more substituents on each of $R^1$–$R^3$ being selected from the group consisting of hydroxy, alkoxy, linear or branched alkyl, aryloxy, halogen, ester, carboxy, nitrile, and amido.

3. Process according to claim 2 wherein $R^1$ and $R^3$ are selected from the group lower alkyl groups and $R^2$ is selected from hydrogen, methyl, ethyl, isopropyl, isobutyl, tertbutyl, amyl, isoamyl, cyclohexyl, phenyl, $CH_3C(O)CH_2$—, $C_2H_5OC(O)CH_2$—, $HOC(CH_3)_2CH_2$—, and

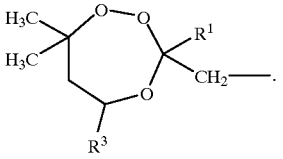

4. Fuel with improved ignition characteristics made by the process of claim 1.

5. Fuel according to claim 4 comprising from 0.001 to 10 percent by weight of one or more trioxepans of formula I (I)

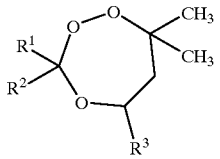

wherein $R^{1-3}$ have the meaning given in claims 1–3.

6. A fuel according to claim 5 comprising 0.025 to 5 percent by weight, based on the weight of the total formulation, of one or more of the trioxepans.

7. A fuel according to claim 4, characterised in that the fuel is a conventional diesel fuel or a liquefied gas.

8. A method of reducing the emission of pollutants from a combustion engine comprising igniting a fuel of claim 4 in the combustion engine.

9. The method of claim 8 wherein the fuel is a liquefied gas and the combustion engine is a diesel engine.

* * * * *